US006122158A

United States Patent [19]

Weber

[11] Patent Number: 6,122,158

[45] Date of Patent: Sep. 19, 2000

[54] WIDE VOLTAGE RANGE DRIVER CIRCUIT FOR A FUEL INJECTOR

[75] Inventor: Robert E. Weber, Newport News, Va.

[73] Assignee: Siemens Automotive Corporation, Auburn Hils, Mich.

[21] Appl. No.: 09/187,836

[22] Filed: Nov. 6, 1998

[51] Int. Cl.[7] ..... H01H 9/00

[52] U.S. Cl. ..... 361/154; 361/160; 361/194

[58] Field of Search ..... 361/154, 152, 361/160, 189, 194; 123/490; 327/108

[56] References Cited

U.S. PATENT DOCUMENTS 4,238,813 12/1980 Carp et al. ..... 361/154
4,292,948 10/1981 Graessley ..... 123/490

*Primary Examiner*—Stephen W. Jackson
*Assistant Examiner*—Sharon Polk

[57] ABSTRACT

A driver circuit is provided for an electromagnetic fuel injector having a coil and powered by a supply voltage. The driver circuit includes a comparator to control activation current to the coil of the fuel injector and transistor structure operatively associated with the comparator and constructed and arranged, together with said comparator, to maintain a hold current of the coil at a constant level slightly above a minimum current required to open the injector, regardless of the supply voltage value. The transistor structure includes first, second, and third transistors. The first transistor is arranged to receive an output of the comparator and to provide a constant current to the second transistor regardless of a value of the supply voltage. The second transistor is operatively associated with the supply voltage and with a high end of the coil. The third transistor is electrically connected to the lower end of the coil so as to sense, in conjunction with a resistor, a current in the coil. The third transistor is also connected to the comparator such that the voltage at the drain of the third transistor is directed to a negative input of the comparator.

17 Claims, 1 Drawing Sheet

WIDE VOLTAGE RANGE DRIVER CIRCUIT FOR A FUEL INJECTOR

FIELD OF THE INVENTION

This invention relates to a driver circuit for a fuel injector and more particularly to a diver circuit for a solenoid-type fuel injector which permits the fuel injector to operate over wide voltage ranges by controlling current to the injector.

BACKGROUND OF THE INVENTION

In the automotive industry there is a movement away from employing a standard 12 volt electrical system to employ a much higher voltage electrical system. The application of conventional 14 volt nominal solenoid activated fuel injectors to automotive electrical systems of much higher voltage such as, for example 42 volts nominal, presents problems to the fuel injector design. Assuming that the typical size of the fuel injector cannot change, and that the fuel injector will most likely be driven by a saturated switch electronic control unit (ECU), major modifications in the coil design of existing injectors will be required. For example, if an existing 14 ohm fuel injector coil consists of 525 turns of #34.5 AWG copper wire, the corresponding coil for a 42 volt operation must be a 126 ohms consisting of 1575 turns of #38.5 AWG copper wire. These calculations follow from the requirement of providing the same number of ampere-turns for an acceptable magnetic force and of maintaining the power dissipation the same in the injector. The use of extremely fine gauge wire is not feasible in the rugged fuel injector environment. For example, by way of comparison, wire size #36 AWG is generally the same thickness as a human hair. Thus, it is expected that the cost of manufacturing these fuel injectors will be higher than that of the conventional fuel injectors due to increased coil failures during manufacturing and assembly.

Since it may not be economically feasible to modify the coil of a fuel injector to operate at the higher voltages, modification of the driver circuit is another approach in widening the voltage range of a fuel injector. Typical methods of driving solenoid activated fuel injectors include using either peak and hold or saturated switch drivers. The peak and hold drivers reduce power consumption but may exhibit problems when the supply voltage increases to the point where the current peaks before the air gap has closed sufficiently for the hold current to latch the armature of the fuel injector. Also, the peak and hold driver circuit is more complex which increases cost.

Saturated switch drivers generally cause high power dissipation in the injector at high supply voltages and also slow the closing time of the injector because of excess energy stored in the magnetic circuit.

Accordingly, there is a need to provide a driver circuit for a solenoid activated fuel injector which provides lower power consumption from the power supply, does not peak too early, and permits injector operation over a large voltage range.

SUMMARY OF THE INVENTION

An object of the present invention is to fulfill the need referred to above. In accordance with the principles of the present invention, this objective is obtained by providing a driver circuit for an electromagnetic fuel injector having a coil and powered by a supply voltage. The driver circuit includes a comparator to control activation current to the coil of the fuel injector and transistor structure operatively associated with the comparator and constructed and arranged, together with said comparator, to maintain a hold current of the coil at a constant level slightly above a minimum current required to open the injector, regardless of the supply voltage value. The transistor structure includes first, second, and third transistors. The first transistor is arranged to receive an output of the comparator and to provide a constant current to the second transistor regardless of a value of the supply voltage. The second transistor is operatively associated with the supply voltage and with a high end of the coil. The third transistor is electrically connected to lower end of the coil and in conjunction with a resistor senses a current in the coil. The third transistor is also connected to the comparator such that voltage at the drain of the third transistor is directed to a negative input of the comparator.

In accordance with another aspect of the invention, a method of controlling the operation of a fuel injector having a coil includes providing a driver circuit for driving the fuel injector. The driver circuit includes a comparator, a first transistor to receive an output of the comparator, a second transistor connected to the supply voltage and to the coil, and a third transistor electrically connected to the coil and to the comparator. A voltage supply is provided to the driver circuit. The driver circuit is driven by an electronic control module, such that at turn-on, the comparator turns-on the first transistor which provides a constant current to the second transistor regardless of a value of the supply voltage. The current at the coil is sensed by the third transistor in conjunction with a resistor. A hold current is maintained at the coil at a level slightly above a minimum level required to activate the coil and open the injector. The drain of the third transistor is directed to a negative input of the comparator upon turning-off the injector.

Other objects, features and characteristic of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE PRESENTLY PREFERRED EXEMPLARY EMBODIMENTS

Figure 1:
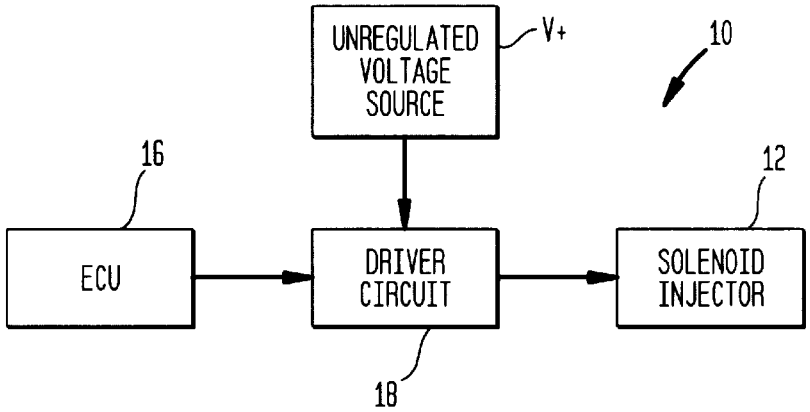
FIG. 1 is block diagram of a control system for controlling a solenoid activated fuel injector including driver circuit structure provided in accordance with the principles of the present invention.

Referring to FIG. 1, a control system is shown, generally indicated at 10, provided in accordance with the principles of the present invention, for controlling a fuel injector of a combustion engine. The fuel injector, generally indicated at 12, includes an electromagnetic coil 14 for opening the fuel injector. The fuel injector 12 is thus of the conventional solenoid type wherein when the solenoid is energized, an armature moves an injector valve (not shown) from a closed position to an opened position. When the power to the solenoid is cut-off, the injector valve moves to the closed position preventing the flow of fuel to the intake manifold of a vehicle.

The system 10 includes an electronic control unit (ECU) 16 and, in accordance with the invention, a driver circuit 18 electrically connected between the ECU 16 and the fuel injector 12. A voltage source V+ is connected to the driver circuit 18. The voltage source V+ can provide a wide range of supply voltages.

Figure 2:
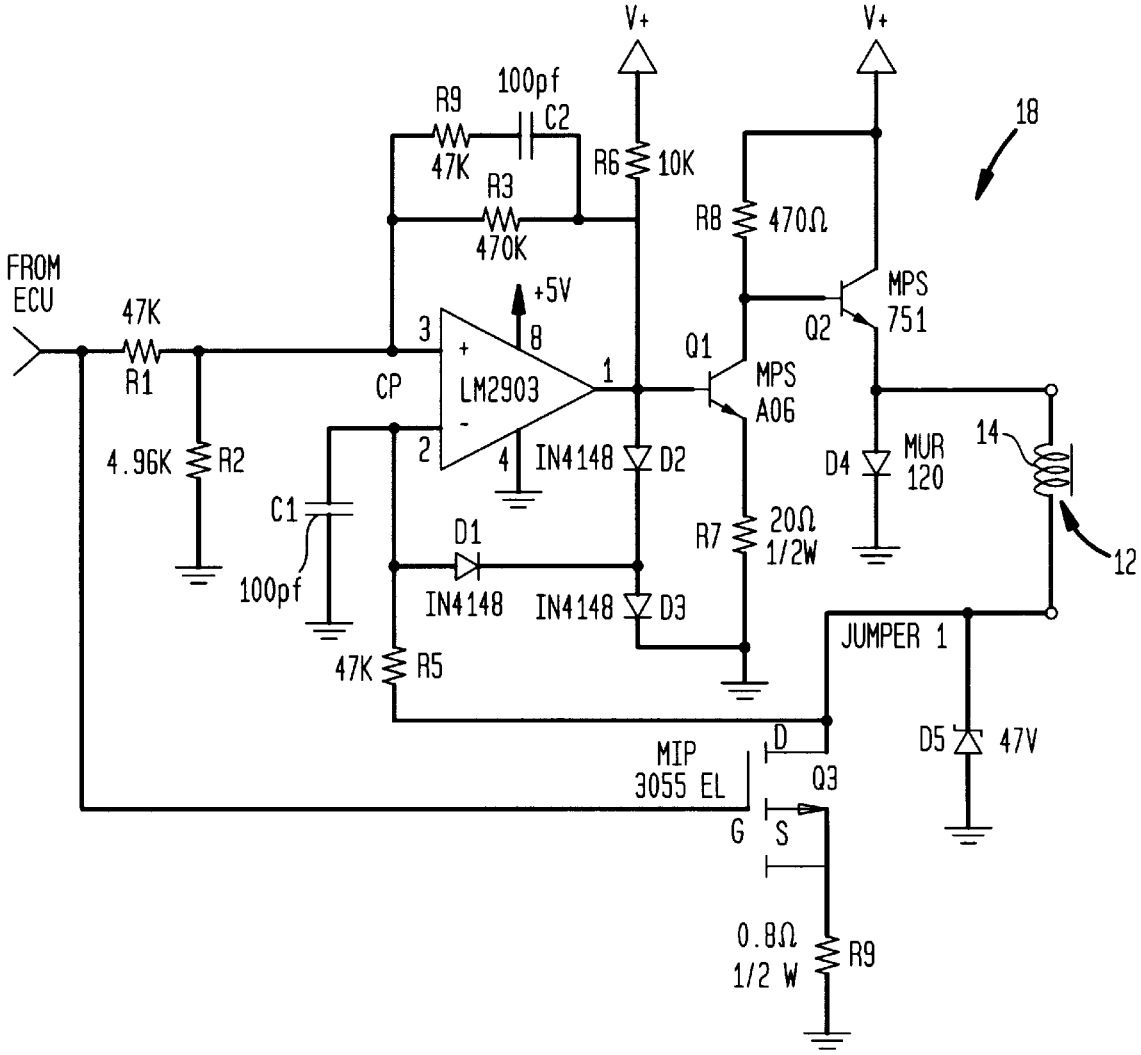
FIG. 2 schematic illustration of driver circuit structure of the invention shown connected to a solenoid activated fuel injector.

An example of the driver circuit 18 is shown schematically in FIG. 2. The driver circuit 18 main components include a single comparator CP that is configured to control the current in the external load, and transistor structure. In the illustrated embodiment, three transistors Q1, Q2 and Q3 are provided which define the transistor structure.

The comparator CP is forced to operate as a switchmode controller by the positive feedback from resistors R3 and R4 and capacitor C2. The ECU 16 delivers a well regulated 0–5 volt input signal. This signal is divided by is resistors R1 and R2 to the proper voltage to command the required current in the injector coil 14. At turn-on, the comparator CP output goes high, turning on transistor Q1. Transistor Q1 is configured as a current sink by the use of diodes D2 and D3 and resistor R7. This arrangement gives constant current to transistor Q2 regardless of the supply voltage. The voltage at Q2's collector switches between the battery voltage and one diode drop below ground as the voltage is clamped by diode D4. Transistor Q3 is also turned-on by the input signal and its resistance is added to that of resistor R9 and is use in sensing the current in the injector coil 14. The voltage at the drain of Q3 is connected to the negative input of the comparator CP through a noise suppression network consisting of resistor R5 and capacitor C1. This completes the basic control loop of the driver circuit 18.

The current in the driver circuit 18 rises until it reaches a control level at which time the loop starts switching to maintain the hold current at a level just above the minimum current level required to open the fuel injector 12. For example, a conventional 14 volt solenoid activated fuel injector is configured to operate at a minimum of 6 volts so as to open upon engine cranking. In the embodiment, the hold current of coil 12 is about 5–10% above the current available at 6 volts. This hold current is generally half the hold current of a conventional saturated switch driven, solenoid activated fuel injector. Advantageously, components of the circuit may be selected specifically to deliver this lower current which may increase performance.

The switching continues until the input signal goes low, turning-off Q3 and voltage at the drain of Q3 returns to the comparator CP. An advantage of the driver circuit structure 18 is seen during turn-off. Since upper end of the injector coil 14 is held one diode below ground and the lower end spikes to the clamp voltage of zener diode D5, the turn-off voltage is independent of the supply voltage. When Q3 turns-off, a portion of the voltage spike is returned to the negative input of the comparator CP, thus guaranteeing a clean turn-off.

Further, constant hold current control to the coil 14 permits the use of a higher supply voltage with the same injector 12. Thus, the operating voltage of the fuel injector 12 may be extended from the conventional 14 volts nominal to 42 or more volts nominal. Supplying a higher supply voltage advantageously opens the injector 12 faster. In addition, since the coil hold current is approximately half of the value which would occur with a saturated switch driver, less energy is stored. Thus, a faster closing time of the injector results.

Since less current is directed to the coil 14, there is less heating of the injector 12 and thus a lower probability of damage to the injector if it were to be operated without fuel. The driver circuit 18 also ensures lower power consumption from the power supply.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A driver circuit for an electromagnetic fuel injector having a coil and powered by a supply voltage, the driver circuit comprising:

a comparator to control activation current to the coil of the fuel injector; and transistor structure operatively associated with said comparator and constructed and arranged, together with said comparator, to maintain a hold current of said coil at a constant level slightly above a minimum current required to open the injector, regardless of the supply voltage value.

2. The driver circuit according to claim 1, wherein said transistor structure comprises:

first and second transistors, said first transistor being arranged to receive an output of the comparator and to provide a constant current to said second transistor regardless of a value of the supply voltage, said second transistor being operatively associated with the supply voltage and with a high end of the coil, and a third transistor electrically connectable to a lower end of the coil so as to sense, in conjunction with a resistor, a current in the coil, said third transistor being connected to said comparator such that voltage at the drain of the third transistor is directed to a negative input of said comparator.

3. The driver circuit according to claim 2, further comprising a resistor and a capacitor arranged between the comparator and said third transistor to define a noise suppression network.

4. The driver circuit according to claim 1, further comprising resistors and a capacitor between the supply voltage and a positive input to said comparator to force the comparator to operate as a switchmode controller due to feedback from said resistors and said capacitor.

5. A driver circuit for an electromagnetic fuel injector having a coil and powered by a supply voltage, the driver circuit comprising:

a comparator to control activation current to the coil of the fuel injector;

first and second transistors, said first transistor being arranged to receive an output of the comparator and to provide a constant current to said second transistor regardless of a value of the supply voltage, said second transistor being operatively associated with the supply voltage and the coil, and a third transistor electrically connectable to said coil so as to sense, in conjunction with a resistor, a current in the coil, said third transistor being operatively associated with said comparator such that voltage at a drain of the third transistor is connected to a negative input of said comparator, said transistors and said comparator being constructed and arranged to maintain a hold current at the coil at a level slightly above a minimum level required to activate the coil and open the injector.

6. The driver circuit according to claim 5, further comprising a resistor and a capacitor arranged between the comparator and said third transistor to define a noise suppression network.

7. The driver circuit according to claim 5, further comprising resistors and a capacitor between the supply voltage and a positive input to said comparator to force the comparator to operate as a switchmode controller due to feedback from said resistors and said capacitor.

8. The driver circuit according to claim 5, in combination with a an electronic control unit connected to a positive input of said comparator.

9. A fuel injector control system comprising:

an electromagnetic fuel injector having a coil;

a driver circuit for driving said fuel injector;

a voltage supply connected to said driver circuit, said driver circuit comprising:

a comparator to control activation current to the coil of the fuel injector;

first and second transistors, said first transistor being arranged to receive an output of the comparator and to provide a constant current to said second transistor regardless of a value of the supply voltage, said second transistor being connected to the supply voltage and to the coil, a third transistor electrically connected to the coil so as to sense, in conjunction with a resistor, a current in the coil, said third transistor being connected to said comparator such that voltage at the drain of the third transistor is directed to a negative input of said comparator, said transistors and said comparator being constructed and arranged to maintain a hold current at the coil at a level slightly above a minimum level required to activate the coil and open the injector.

10. The system according to claim 9, wherein said supply voltage is in the range of 14 to 42 volts.

11. The system according to claim 9, wherein a high end of said coil is connected to said second transistor and a low end of said coil is connected to said third transistor.

12. The system according to claim 9, wherein a voltage of said second transistor is clamped by a diode and switches between the supply voltage and one diode drop below ground.

13. The system according to claim 12, wherein a zener diode is provided between said low end of said coil and said third transistor, and wherein at turn-off of the injector, the low end of said coil spikes to a clamp voltage of said zener diode such that a turn-off voltage is independent of the supply voltage.

14. The system according to claim 9, further comprising a resistor and a capacitor arranged between the comparator and said third transistor to define a noise suppression network.

15. The system according to claim 9, further comprising resistors and a capacitor between the supply voltage and a positive input to said comparator to force the comparator to operate as a switchmode controller due to feedback from said resistors and said capacitor.

16. A method of controlling operation of a fuel injector having a coil, comprising:

providing a voltage supply;

providing a fuel injector driver circuit, said driver circuit including a comparator, a first transistor to receive an output of the comparator, a second transistor connected to the voltage supply and to the coil, and a third transistor electrically connected to the coil and to said comparator;

driving said driver circuit with an electronic control module, such that at turn-on, said comparator turns-on said first transistor which provides a constant current to said second transistor regardless of a value of the voltage supply;

sensing a current at said coil with said third transistor in conjunction with a resistor; and maintaining a hold current at said coil at a level slightly above a minimum level required to activate the coil and open the injector.

17. The method according to claim 16, further including directing a drain of the third transistor to a negative input of said comparator upon turning-off the injector.

* * * * *

UNITED STATES PATENT AND TRADEMARK OFFICE

CERTIFICATE OF CORRECTION

PATENT NO. : 6,122,158
DATED : September 19, 2000
INVENTOR(S) : Robert E. Weber

It is certified that error appears in the above-identified patent and that said Letters Patent is hereby corrected as shown below:

Drawings,
Fig. 2 should be deleted to appear as shown below:

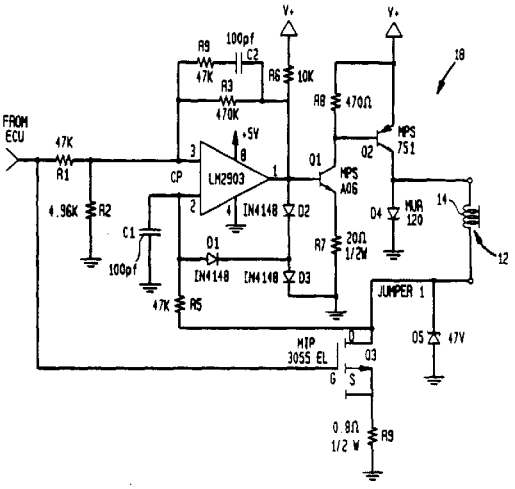

Signed and Sealed this

Twenty-third Day of July, 2002

*Attest:*

*Attesting Officer*

JAMES E. ROGAN
*Director of the United States Patent and Trademark Office*